US010504336B2

(12) United States Patent
Kogler et al.

(10) Patent No.: US 10,504,336 B2
(45) Date of Patent: Dec. 10, 2019

(54) GAME-RIDE SYSTEM

(71) Applicants: Stefan D. Kogler, Milford, MI (US); Clifford A. Jennings, Highland, MD (US)

(72) Inventors: Stefan D. Kogler, Milford, MI (US); Clifford A. Jennings, Highland, MD (US)

( * ) Notice: Subject to any disclaimer, the term of this patent is extended or adjusted under 35 U.S.C. 154(b) by 0 days.

(21) Appl. No.: 15/990,762

(22) Filed: May 28, 2018

(65) Prior Publication Data

US 2019/0139368 A1 May 9, 2019

Related U.S. Application Data

(60) Provisional application No. 62/516,840, filed on Jun. 8, 2017.

(51) Int. Cl.

| | |
|---|---|
| ***G07F 17/32*** | (2006.01) |
| ***A63G 31/02*** | (2006.01) |
| ***A63G 33/00*** | (2006.01) |

(52) U.S. Cl.

CPC ..... *G07F 17/3293* (2013.01); *A63G 31/02* (2013.01); *A63G 33/00* (2013.01); *G07F 17/3204* (2013.01)

(58) Field of Classification Search

None

See application file for complete search history.

(56) References Cited

U.S. PATENT DOCUMENTS

| | | | | |
|---|---|---|---|---|
| 2012/0226981 | A1* | 9/2012 | Clavin | G06F 3/005 715/719 |
| 2013/0045804 | A1* | 2/2013 | Ruke | A63G 31/00 463/42 |
| 2013/0176727 | A1* | 7/2013 | Desmet | G02B 6/0073 362/241 |
| 2014/0343701 | A1* | 11/2014 | Song | A63B 71/06 700/92 |

* cited by examiner

*Primary Examiner* — Ronald Laneau

(57) ABSTRACT

The present invention discloses a novel Game-Ride System: a game in which people can physically ride the playing pieces. Simultaneously it is a physical ride whose passengers, via their vehicles, can be "played with" and, in certain embodiments, wagered upon. A typical application incorporates an overall electronic game control subsystem adapted to playing a particular kind of game, accepting input from one or more playing consoles (whether local or remote), and issuing various commands for display of game progress and outcomes. However, in the present invention, the display means is very much augmented, involving a physical ride subsystem where people are riding on or in actual physical elements of the game being played. Such a correlation of, and interaction between, ride and game provide novel and exciting entertainment for player, rider and observer.

17 Claims, 8 Drawing Sheets

GAME-RIDE SYSTEM

CROSS-REFERENCES TO RELATED APPLICATIONS

U.S. PATENT DOCUMENTS

| Pat. No. | Date | Inventor(s) | US Class. |
|---|---|---|---|
| US20070078016A1 | TBD | Henry et. al. | 472/128 |
| U.S. Pat. No. 6,027,115A | 2000 Feb. 22 | Griswold et. al. | 273/143 |
| U.S. Pat. No. 7,306,516B2 | 2007 Dec. 11 | Iosilevsky | 463/13 |
| U.S. Pat. No. 6,095,926A | 2000 Aug. 1 | Hettema et. al. | 472/59 |

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

REFERENCE TO A "SEQUENCE LISTING," TABLE, ETC.

Not applicable.

BACKGROUND OF THE INVENTION

1. Field of the Invention

The present invention relates to a game-playing environment, in conjunction with a physical ride system, particularly where public engagement for entertainment and perhaps gambling purposes is involved.

2. Description of Related Art

Casinos and other game-oriented venues have various games designed for operation by, and entertainment of, single players or small groups of players, with the equipment and playing pieces involved being on that scale. Game opportunities for truly large-scale observation and interaction are lacking, as are opportunities for passengers to actually ride on the equipment or playing pieces used in the game.

A typical example of the art is the slot machine by Griswold (U.S. Pat. No. 6,027,115A), a machine designed for a single player. As with numerous slot machine inventions, there is player interaction, moving parts, and stimulation with various the visual elements. But the scale is small; and there is no provision for other guests to immerse themselves in the game, that is, to physically ride the slot machine while it is being played.

Other examples from the casino world abound, such as those entirely based upon electronic displays, e.g., as disclosed in the electronic card playing table by Iosilevsky (U.S. Pat. No. 7,306,516B2). Though the playing and observing group is larger, there still lacks the scale and opportunity for other guests to literally ride the cards being played with.

From the amusement park industry, there have been many forms of rides patented since the 19$^{th}$ century. Yet though one might place an informal wager on some facet of such a ride, there lacks the opportunity to formally wager, let alone wager in such a way that the ride actually represents the playing components of a certified gambling game. This is most likely at least in part due the family nature of amusement parks, and the more adult nature of gambling facilities. As just one example, the invention of Hettema at. al. (U.S. Pat. No. 6,095,926A) discloses a motion-base dark ride vehicle. Yet it has no connectivity with an overall game system, where the vehicle is a game element being played with or wagered upon by other parties.

From the water park industry, some thought has been placed on being able to bet while on a "ride." Henry (US20070078016A1) describes such an activity. Yet the "ride" is a fluid one, where people are allowed to move or slide freely, encountering discrete games as desired without their position or "vehicle" (e.g., an inner tube floating in the water) being controlled by a central subsystem. There is no larger game present, and no other people are betting on those within the water "ride."

Many games have moving playing pieces which, if scaled and configured appropriately, would permit an opportunity for guests to ride them while other "players" are affecting their motions. No prior art for this notion has been discovered by the present inventors.

Many forms of amusement ride exist, and other "players" could theoretically move those pieces and even wager on aspects of their outcomes. Yet no combination of the two, designed as an overarching game, has been discovered by the present inventors.

Finally, a variety of electronic games exist where the actions of a player are used as inputs to game contained entirely within a computer-controlled set of electronic equipment. An example is Clavin (US20120226981A1), where user's physical motions are interpreted as game inputs; also Song (US20140343701A1), where specialized garments serve as input devices. Another example is Ruke (US20130045804A1), where the user-controlled "ride" involved is a virtual "computerized theme park ride" having no actual mechanical vehicles. The present invention, however, involves a physical mechanical ride system (as opposed to a virtual or computer-contained one), with playing console inputs affecting that physical passenger-carrying ride or information displayed within it.

SUMMARY

The present invention approaches a game in a novel and exciting means: the playing pieces or equipment are something that people actually ride while the play is taking place. To a significant degree, the present invention exchanges the typical small-scale game playing devices and pieces with large-scale versions that can actually convey passengers.

The present invention simultaneously approaches an amusement ride in a novel and exciting means, in that the vehicle in which one is riding is a game element being bet on or with. To a significant degree, the present invention exchanges the typical self-contained and merely observational "dark ride" experience with that of being on the stage, under the spotlights, and in the game.

In one embodiment of the present invention the game involves playing cards, and the ride subsystem is configured to have rolling ground-based vehicles having video screens displaying images of the cards. In another embodiment the game is a huge slot machine, with the ride subsystem utilizing Ferris-wheel mechanisms having individual cabins displaying the slot machine characters and symbols. In another embodiment the game involves dice, and the ride subsystem is configured to use ground-running vehicles having revolving cubes displaying alternating faces of a die. In yet another embodiment the game involves dominoes, and the ride subsystem employs water-based vehicles having faces displaying combinations of dots for a particular domino value.

Many other examples can be added to this recitation. In all these varied cases, however, the present invention utilizes a common core of components. These are: at least one playing station; a ride subsystem, conveying at least one passenger, reacting to conditions the game; and a game control subsystem that accepts player input and manages certain factors of the ride subsystem's behavior.

TERMS

Facility: the physical location in which the Game-Ride System is substantially deployed.

Playing Station: a location whereat one or more people play the game, using an electronic interface to the Game-Ride System.

Observation Area: a location whereat one or more people observe the Game-Ride System's ride features, playing stations, or both.

Game Control Subsystem: the control subsystem that, in compliance with applicable regulations, accepts instruction from Playing Stations, manages outcomes as appropriate for the specific game, and issues display and (for some embodiments) position commands to the Ride Control subsystem.

Ride Control Subsystem: the control subsystem that, according to necessary logistical and safety parameters, governs ride vehicle operation; and as directed by the Game Control System, manages various visible attributes of the vehicle(s).

Vehicle: the machinery within or upon which passengers ride, containing one or more opportunities for passenger placement.

Vehicle Seating: a portion of the Vehicle designed for one or more passengers to be safely positioned for a ride.

Vehicle Display: one or more elements of the Vehicle that, according to instruction from the Game Control System, display a certain attribute such as a face of a card, a position of a die, a dot pattern of a domino, a figure of a slot machine wheel, a numerical value, etc.

Ride Subsystem: The combination of said Ride Control Subsystem and one or more Vehicles, each having Vehicle Seating means and Vehicle Display elements.

DETAILED DESCRIPTION OF THE INVENTION

Figure 1:
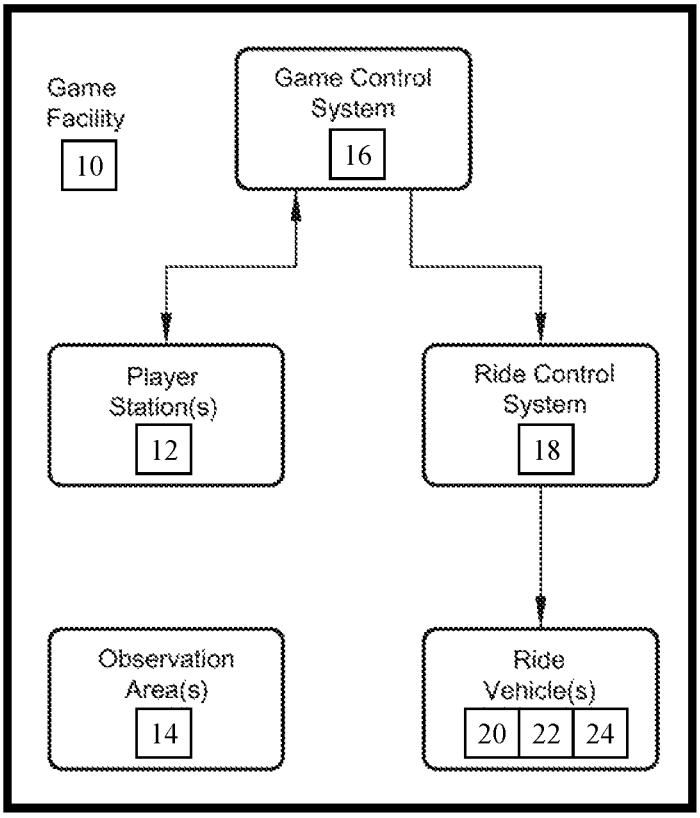
FIG. 1: A flowchart showing a typical hierarchy of subsystems.

The present invention is described in diagrammatic form in FIG. 1, showing a basic hierarchy of key elements typically involved. A Facility 10, such as a casino, amusement park, resort, or a purpose-built stand-alone venue, contains the Game-Ride System, including Playing Stations 12 and Observation Areas 14 permitting non-players the opportunity to witness the game. A digital Game Control System 16 accepts inputs from the Playing Stations 12 and drives the various display elements of the Game-Ride System.

Though the aforementioned elements may describe a conventional casino or arcade containing electronic game machines, the present invention varies greatly in how the visual elements of the game are expressed, in that certain display components are much larger and permit passengers to ride them. Thus a Ride Control Subsystem 18 accepts instruction from the Game Control Subsystem 16, and manipulates display elements such as the positions of the vehicles, digital imagery presented on vehicle video screens, and additional controllable features installed upon or near the vehicles. The Vehicle 20 therefore incorporates Vehicle Seating 22 for at least one passenger and at least one means of on-board Vehicle Display 24 to emulate or indicate game parameters.

In some embodiments the Vehicle 20 is a larger machine containing multiple cabins or Seating compartments 22. In this case, a larger "carnival ride" design, such as a "Ferris wheel" or "round-about," may be adapted for the purpose. In other embodiments, multiple discrete Vehicles 20, each having more limited Seating 22, may be employed. In this case, the vehicle might be more analogous to one of several cars or boats or other conveyance means moving along a path. In still other embodiments the Vehicle is quite small, perhaps supporting only one rider, and moving in various degrees of freedom while its motion platform remains substantially in place.

Figure 2:
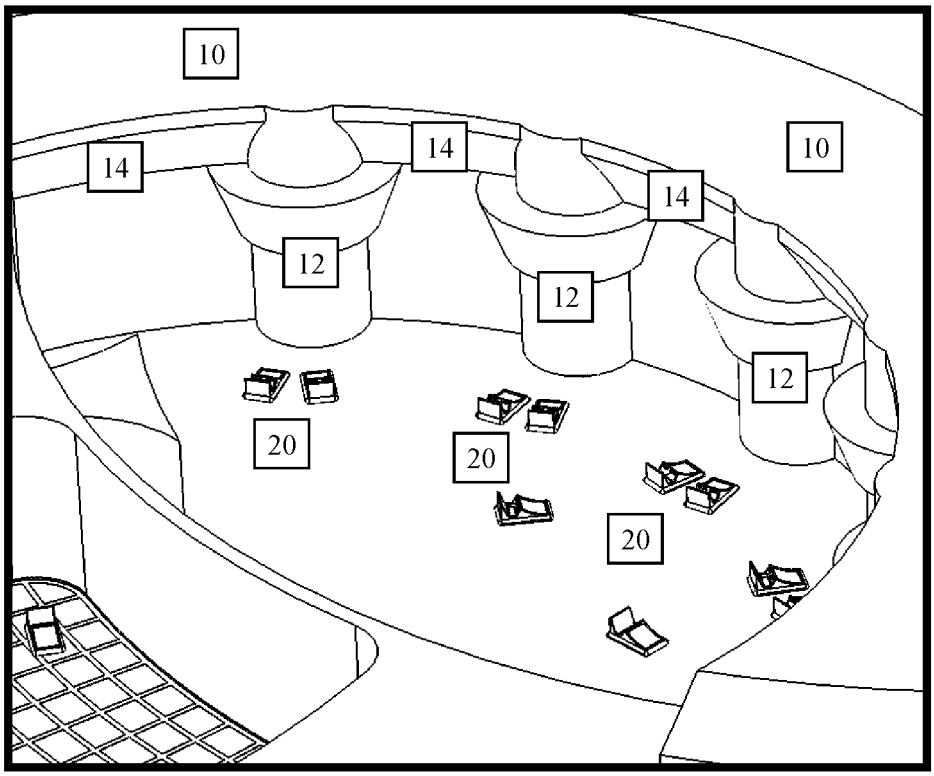
FIG. 2: An embodiment of the present invention related to playing cards, showing an overall facility.
Figure 3:
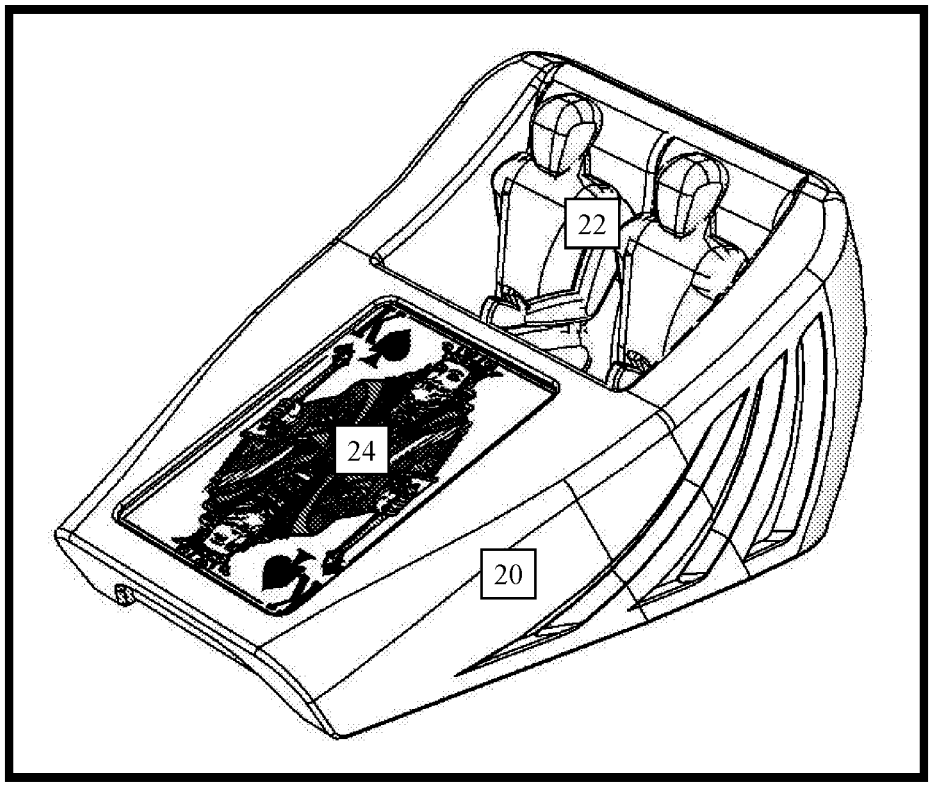
FIG. 3: An embodiment of the present invention related to playing cards, showing passenger vehicles.

FIG. 2 illustrates an embodiment of a playing-card application utilizing multiple Vehicles 20. Vehicles are sent from an area architecturally representing a card-dealing "shoe" and onto a "table" area having adjacent Playing Stations 12 and Observation Areas 14. As shown in FIG. 3, each Vehicle represents one card, the face of which is displayed on a video Display 24. The card image presented on said Display is not static, but instead governed by the Game Control System 16. Seating 22 permits at least one passenger to ride the Vehicle 20 as it goes through its motions during the game. In this embodiment, multiple types of games based upon playing cards may be played. Note also that video imagery presented may be of any kind, portraying such gaming elements as such as dice, chips, dominos, text, advertisement, and so forth, as game and venue require.

Furthermore, there may be more than one game or other ride space wherein the Vehicles operate within the Facility, permitting a sequence of games and/or other experiences for the passengers, and even a variety of kinds of games that the ride vehicles represent elements of. An example would be the vehicles of FIG. 3, where displayed graphics change as needed by differing game types.

Figure 4:
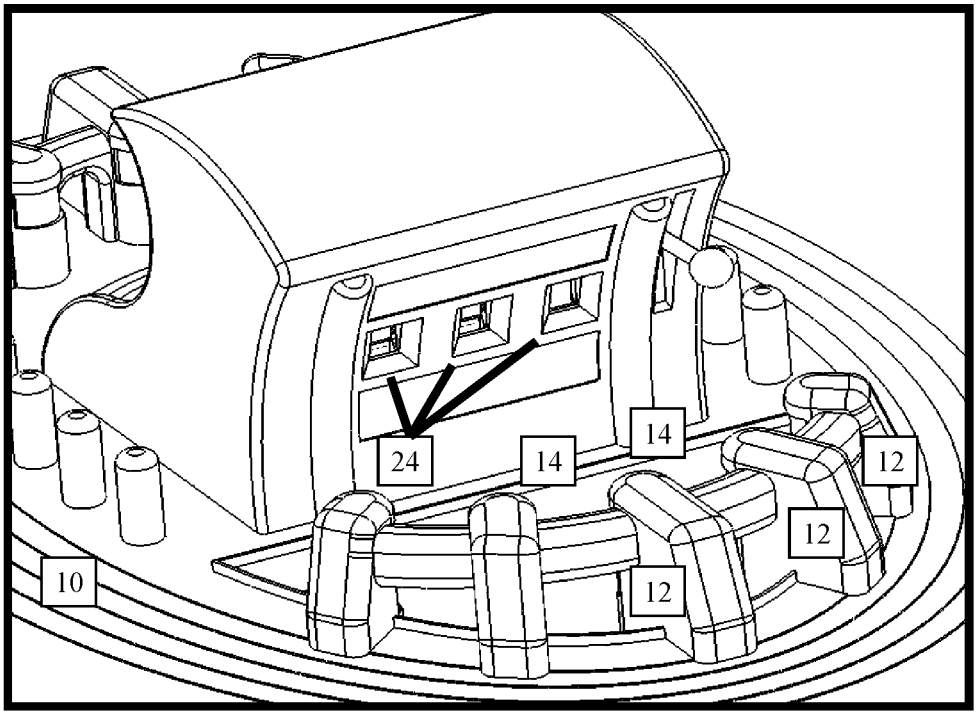
FIG. 4: An embodiment of the present invention related to a slot machine, showing an overall facility.
Figure 5:
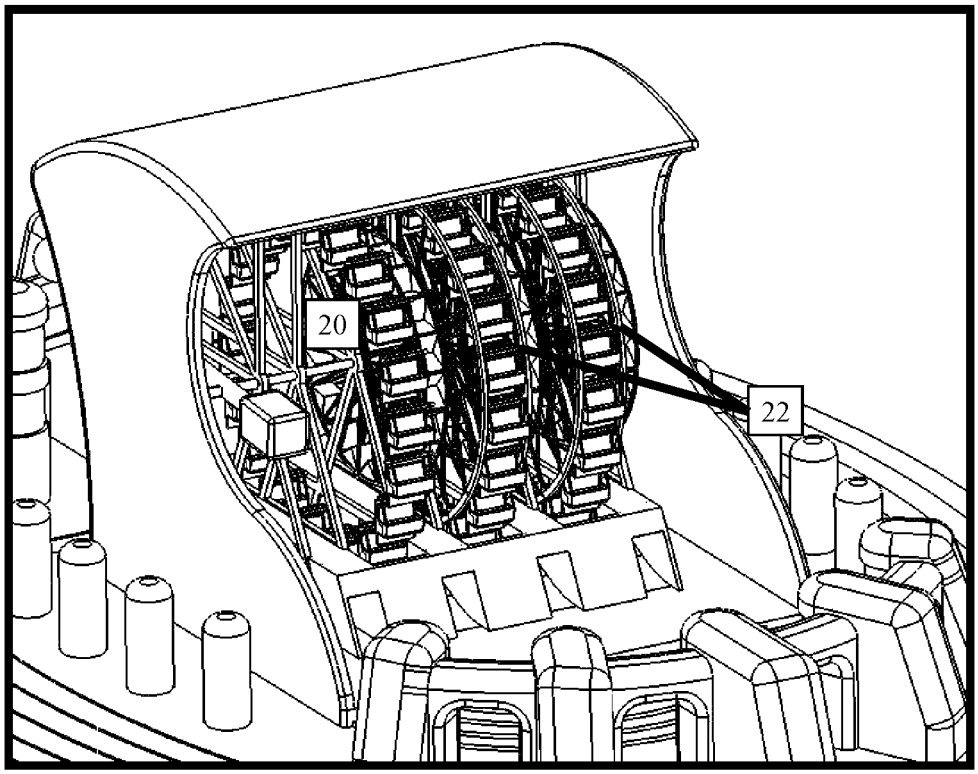
FIG. 5: An embodiment of the present invention related to a slot machine, showing passenger compartments.

FIG. 4 presents a slot-machine embodiment where multiple Playing Stations 12 are arrayed around a large "slot machine" structure incorporating several Ferris wheel-type vehicles. Each passenger cabin of each wheel has, on the side presented to those at the Playing Stations 12, a video screen conveying slot machine figures, displayed though apertures in the architecture. This combination of screen and architectural reveal comprise Vehicle Display 24. Referring to FIG. 5, the application may involve three large rotating ride Vehicles 20, having multiple Seating compartments 22 within each.

Figure 6:
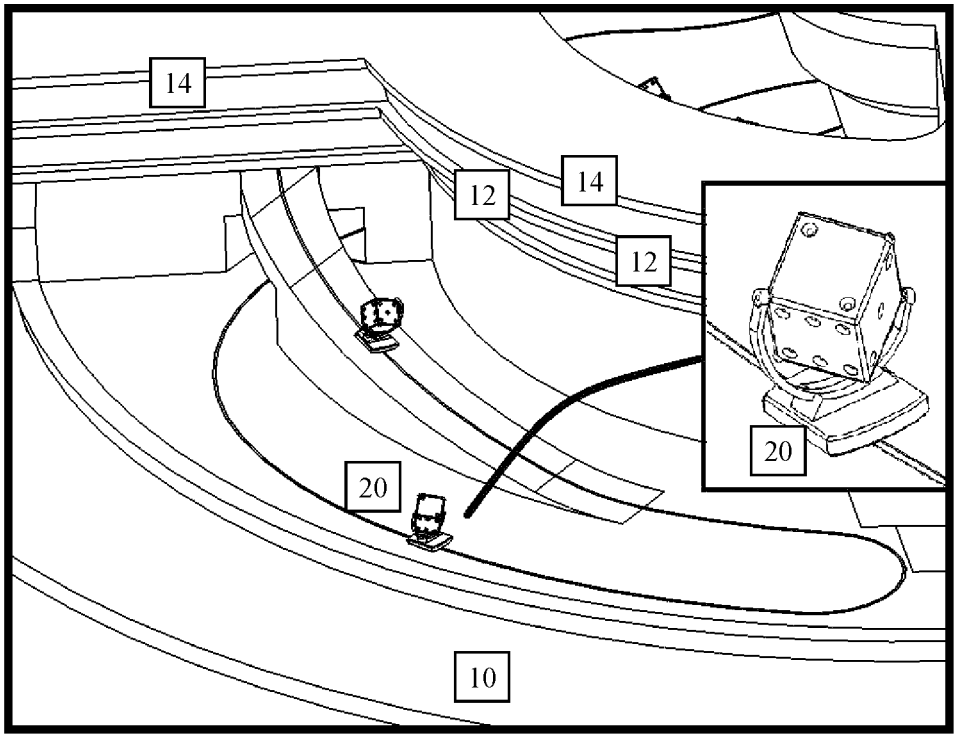
FIG. 6: An embodiment of the present invention related to dice, showing an overall facility.
Figure 7:
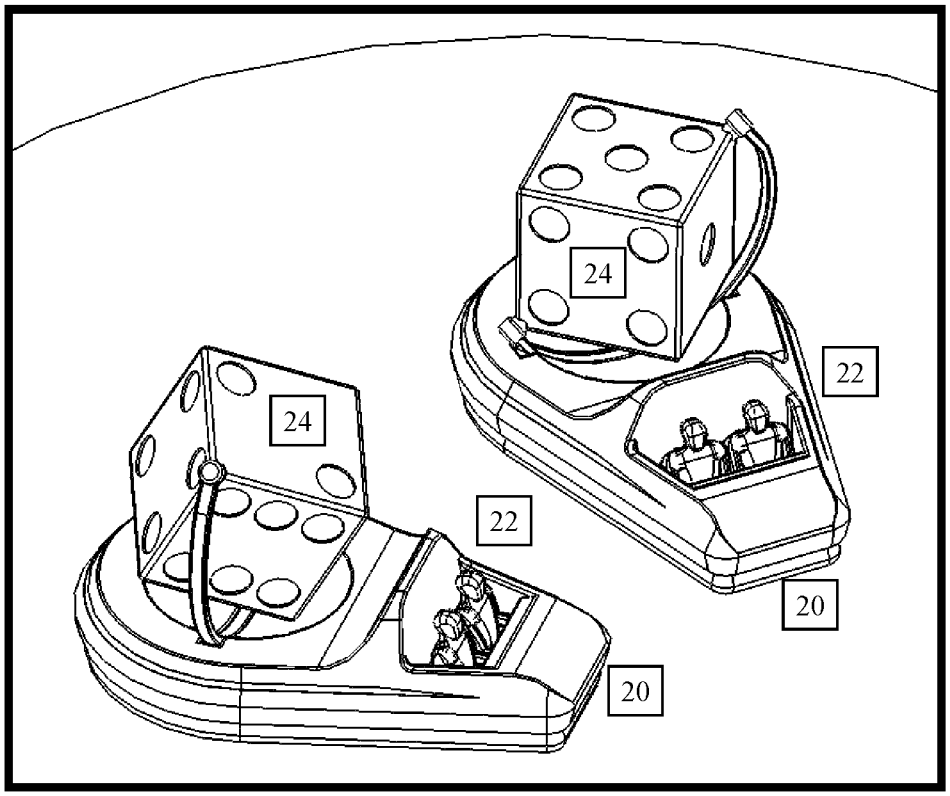
FIG. 7: An embodiment of the present invention related to dice, showing passenger vehicles.

FIG. 6, in a dice-oriented embodiment, emphasizes a rolling of the dice on a large "craps table," again with adjacent Playing Stations 12 and Observation Areas 14. The Vehicles 20 here have large semi-transparent dice cubes that revolve around passengers seated within. An alternate vehicular form is illustrated in FIG. 7 where the ride passengers sit in front of revolving dice. In both cases, rather than a video screen, the revolving die is the Vehicle's primary Display element 24. Still another vehicle approach would be that of FIG. 3, where the revolving dice are displayed purely as graphic imagery on the Vehicles' video screens.

Figure 8:
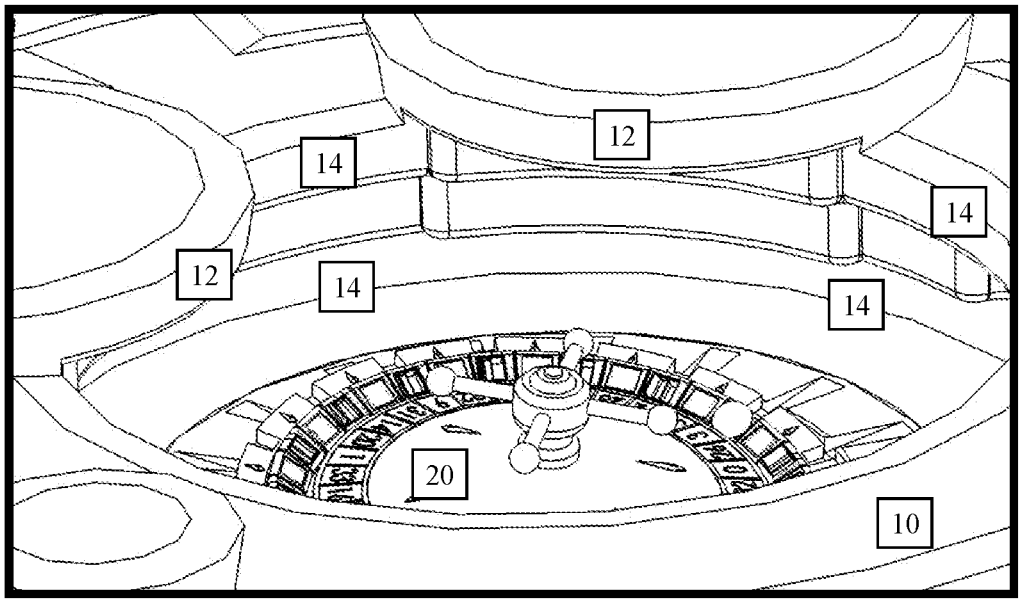
FIG. 8: An embodiment of the present invention related to a roulette wheel, showing an overall facility.
Figure 9:
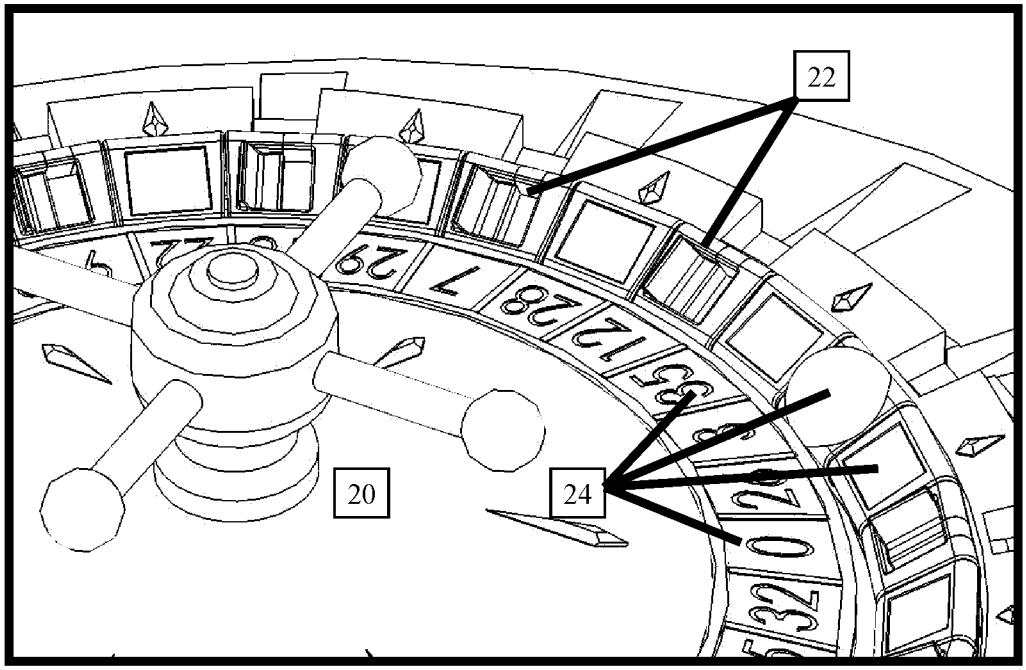
FIG. 9: An embodiment of the present invention related to a roulette wheel, showing passenger compartments.

FIGS. 8 and 9 show a "roundabout" form of amusement ride, here modified to appear as a roulette table with elevated Playing Stations 12. Observation Areas 14 involve the entire perimeter of the ride and also elevated galleries. While tilting about two axes, the inner wheel of Vehicle 20 rotates in one direction, while its outer ring containing Seating 22 rotates oppositely. Vehicle Display 24 involves illuminated numbers, and also the roulette "ball" itself which can be a fixed physical feature in the outer ring as shown, a mechanically actuated prop located in numerous positions, or imagery displayed on video screens between the Seating compartments 22. Thus the Display features 24 may be approached in several ways.

Numerous additional embodiments can be readily perceived by those schooled in the art by varying the factors of game application and ride subsystem. Potential game applications include numerous forms that have cards or dice as a common factor. Other games having more specialized playing pieces may also be adapted, as the embodiments of slots and roulette demonstrate, with many additional applications available such as Pai Gow, Pachinko, Pinball, Wheel of Fortune, Mah Jongg, dominoes, and so forth. Furthermore, one may vary the form of ride system, exploring numerous modes of transport and selecting that which best suits the particular game, venue, theme, and clientele involved. The common thread in all such combinations and resultant embodiments remains the particular set of elements recited in FIG. 1.

Numerous further embodiments can be achieved by adding further ride features. One example is the adaptation of the application toward a plurality of "tables," in which the vehicle and rider(s) are sequenced through several games or even kinds of games, with the vehicle display features adapting themselves accordingly. Another example is a prelude "fun ride" where card-vehicles are "shuffled" or dice-vehicles are "rolled." Still another example involves a "dark ride" story experience before, after, or between game-playing episodes, permitting a ride experience having greater duration and experiential variety.

In certain vehicular applications, such as those having a plurality of vehicles representing cards or dice, additional platforms may support or convey various forms of props also controlled by the Game Control System, depending on the game. An example involves one or more stacks of poker chips, which either by way of lighting, video imagery, kinematic motion, or a combination, convey indication of chip value and quantity. The entire assembly may be located statically, or in a mobile fashion allowing it to circulate among card-based Vehicles 20, such as are shown in FIG. 3.

Public participation with the Game-Ride System is primarily by one of three avenues: observation, game-playing, and ridership. The observation element, as with any game that draws interest from passersby, is clearly evident. However, the present invention invites and facilitates large-scale public spectacle both in local and remote (e.g., CCTV, Internet) means. For in-person observation, and referring to FIGS. 2, 4, 6 and 8, the Facility 10 may have its Observer Areas 14 facilitated by dedicated architecture, or spatially integrated with the Playing Stations 12. The Vehicles 20, with their surrounding equipment and architecture, can be further designed as a spectacle in themselves for viewing by the general public, in addition to viewing by those within the Facility.

Game-playing participation is, in the preferred embodiment, performed at Playing Stations which involve a user interface having video screens, input buttons, payment devices, and other interface features such as are known to those schooled in the art of electronic game machines and electronic table games. In a preferred embodiment this user interface is in the form of a console in visual communication with the ride, such that visible characteristics and behaviors of the ride vehicle(s) and associated display(s) take the place of certain playing elements of the conventional game. That is, visible features of the ride take the place of conventional cards, dice, roulette wheels, slot machine disks, etc., or their video counterparts in electronic versions, as the application requires.

Ridership participation here is fundamentally for the purpose of enjoying being "a part of the game," and even "on the stage" and "in the spotlight." However, additional on-board game features may be incorporated for further entertainment value to the rider. Such features may include buttons, video screens, speakers, electronic "guns," or other interactive devices mounted in the Vehicle Seating area. The overall Game-Ride System may further include similar such devices installed in the queue line for the ride. In the preferred embodiment these secondary playing means, with their displays and software, are independent from the primary game controlled by the Game Control System, that is, they have no connection to the game outcomes which the ride subsystem displays to a player at a primary Playing Station. Even so, the secondary and independent games played by passengers can have a richness of experience all their own, and even indeed be of legitimate and certified nature for applications involving gambling. That is, while a vehicle represents a playing piece of a larger game, it may simultaneously contain its own independent game for play by the rider.

In some embodiments the vehicle may therefore be equipped with means of on-board play, providing riders an opportunity for interaction and facilitating a number of gaming modes, including, but not limited to, shooting at a target; tapping a button at the right moment in time; manipulating a joystick; and so forth. In all such interactions, a secondary subsystem can record and score the actions of riders, permitting that score to be displayed to the rider at the end of the ride, and optionally be useful in adjunct game activities and reward means, local or remote.

The Game Control System completely controls the display aspects of what is shown to the player at a Playing Station, including video and text on the Playing Station's console and imagery presented on Vehicle Display screens. Depending on the embodiment, vehicle position may be also controlled as part of the suite of controlled Display elements. The Game Control System may further control elements of audio, facility video screens, lighting, special effects, unmanned vehicles conveying props, kinematic animation, and so forth, as the application invites. The Ride Control System may further control Vehicle elements of audio, lighting, special effects, kinematic feature animation (such as an onboard animated figure), and so forth, as the application invites.

In some embodiments the Playing Station is remote from the ride, yet incorporates a video feed of ride activity. "Remote" here can refer to a similar Playing Station console removed from visual ride communication, or a personal computer using specialized software and the Internet as the communication means. However, even though remote, the experience for the player remains that of real-time engagement with the live event of a game that people are actually riding upon or within.

In the preferred embodiment of multiple Vehicles representing cards, dice or other movable game elements operating individually along a floor surface, the vehicle is of a design requiring no visible track guide rails, and having the ability to move upon a variety of paths. In the preferred embodiment, the Ride Control Subsystem performs all vehicle navigation, without any intervention on the part of the passenger(s).

In certain embodiments the Vehicle and its platform of operation may be quite small and more integrated as a product. For example, a mechanical animal may comprise the entire ride. Though not translating along a path, its motions in other degrees of freedom (pitch, roll, yaw, and heave) constitute its vehicular nature; and a single seat upon said animal constitutes the vehicle's Seating area. The Player Station may be nearby, with Game and Ride control subsystems being integrated and co-located; and the entire system can be installed on a common platform. Though very different from the larger scale embodiments, the basic elements of the present Game-Ride System invention of FIG. 1 are incorporated.

Figure 10:
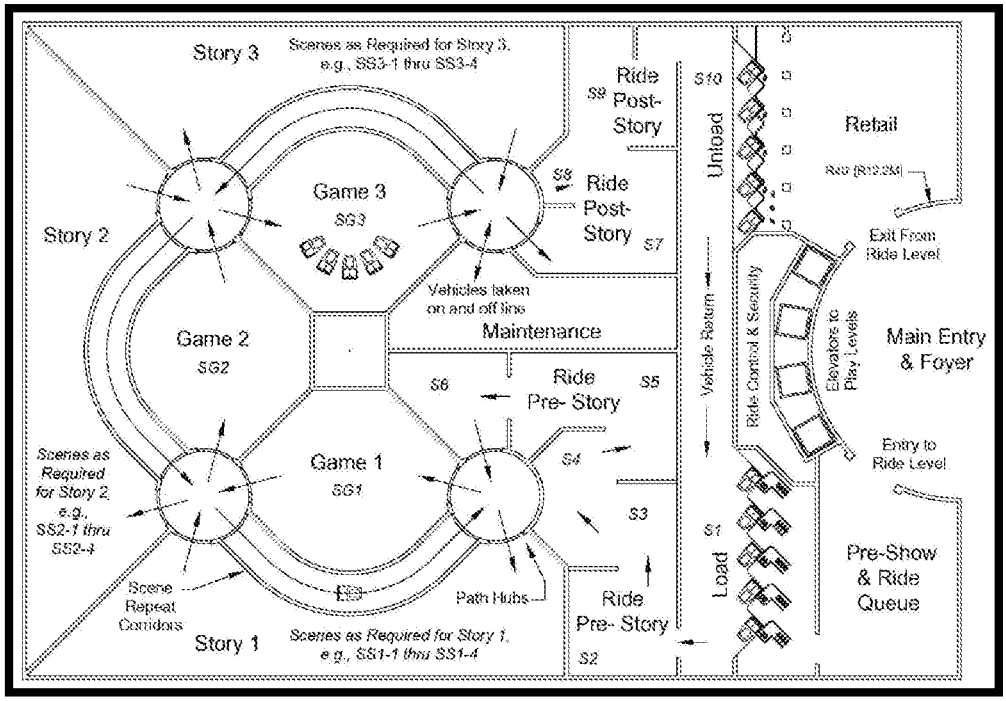
FIG. 10: An embodiment of the present invention related to games involving cards or dice, showing the first floor of an example facility.

To illustrate the interplay between game and ride, one embodiment will be elaborated upon. In this example the application involves a ride system on the first floor of a Facility (FIG. 10). At this level are conventional "dark ride" features typical for a theme park, such as a grand entry, pre-show walk-through while waiting in line, and then the ride having story-scene areas along the ride; and finally, a retail space after the ride exit. What differs greatly here is the addition of game spaces, "theaters" wherein the ride vehicles (with their passengers) comprise the playing pieces in a much larger game. Depending upon numerous game-based factors, the vehicles may be sent only through the story scenes, only through the game scenes, or a mix of both. Hubs in the ride path permit such choices, with the reversal corridors connecting the hubs permitting a return to a prior point to either experience a missed scene (e.g., a story scene), or to repeat a scene (e.g., going back to participate in a second hand of poker).

Figure 11:
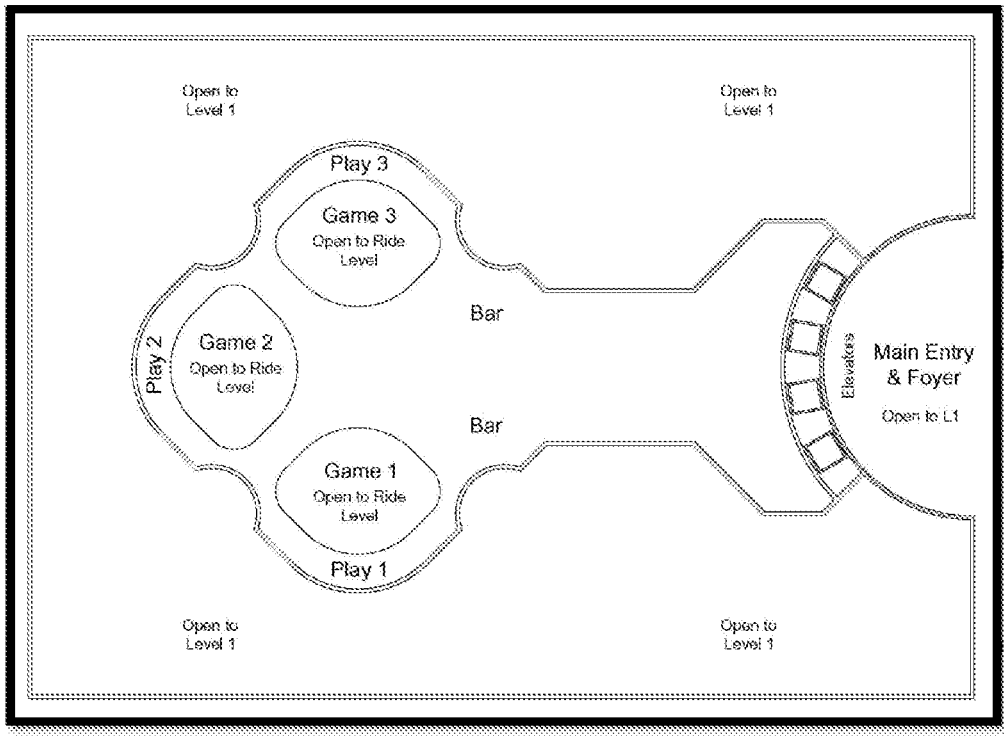
FIG. 11: An embodiment of the present invention related to games involving cards or dice, showing the second floor of an example facility.
Figure 12:
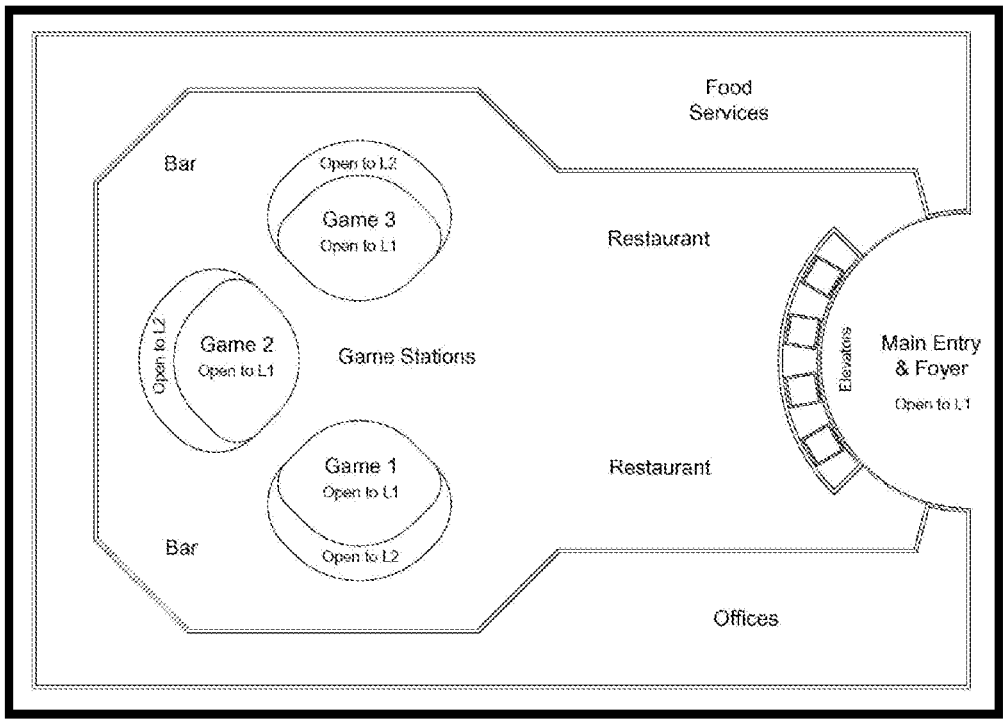
FIG. 12: An embodiment of the present invention related to games involving cards or dice, showing the third floor of an example facility.

Continuing the example, FIG. 11 illustrates the second floor of the same Facility, where those playing the larger game have Playing Stations with consoles looking directly down upon the game spaces of the ride. FIG. 12 shows a third level for the general public where additional adjunct playing consoles (not affecting the larger game), food & beverage areas, and infrastructural spaces (such as those housing the Game and Ride Control Subsystems), are arranged.

Figure 13:
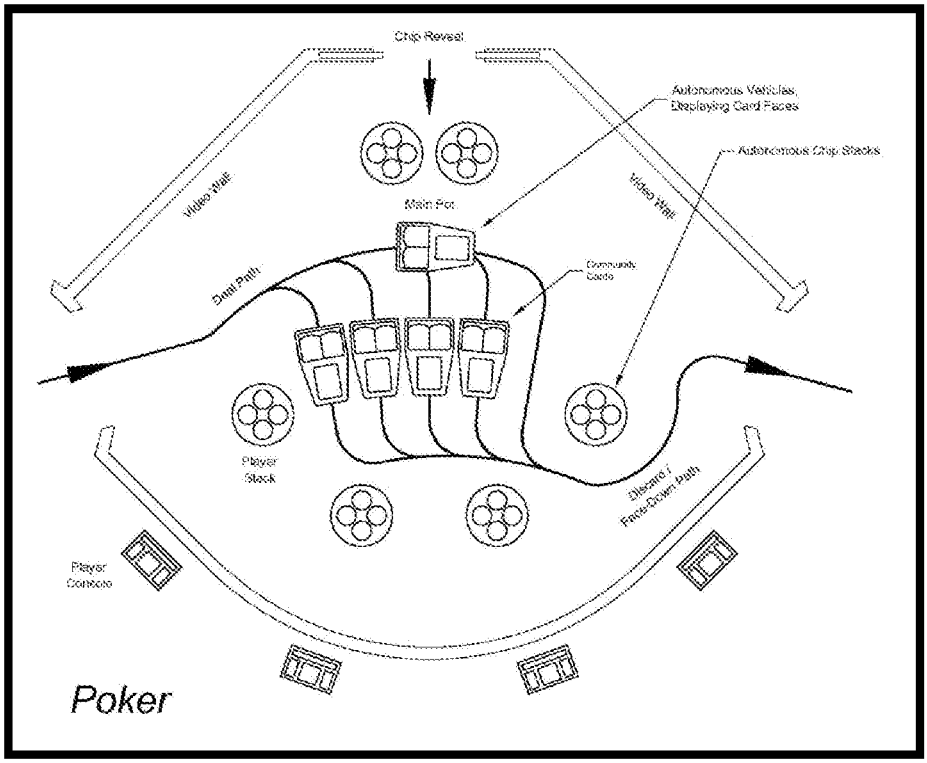
FIG. 13: An embodiment of the present invention related to games involving cards or dice, showing a facility game area arranged for the game of poker.
Figure 14:
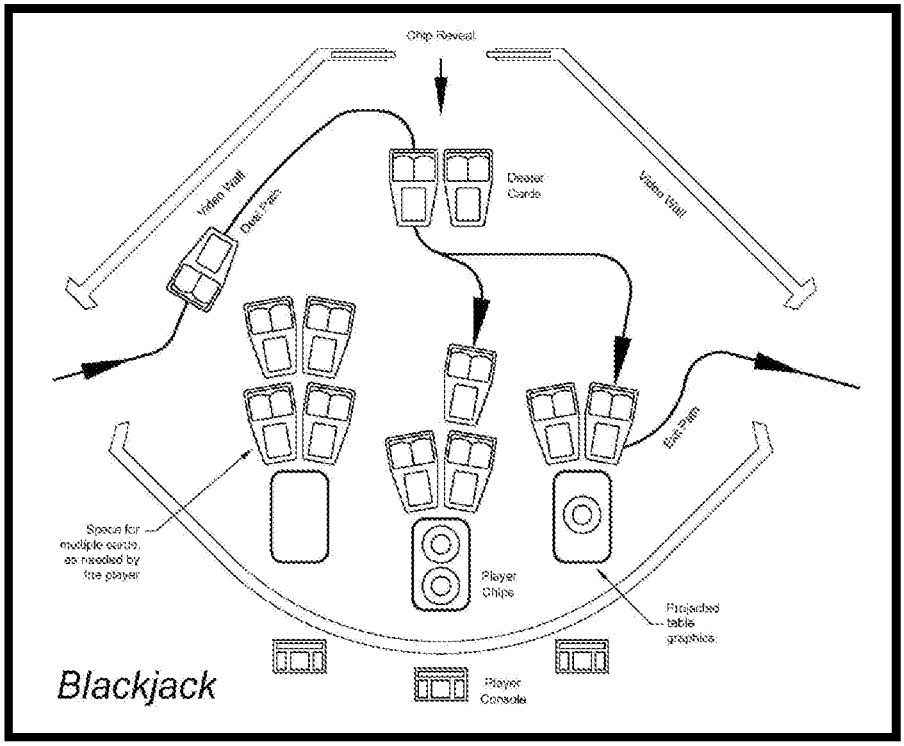
FIG. 14: An embodiment of the present invention related to games involving cards or dice, showing a facility game area arranged for the game of blackjack.
Figure 15:
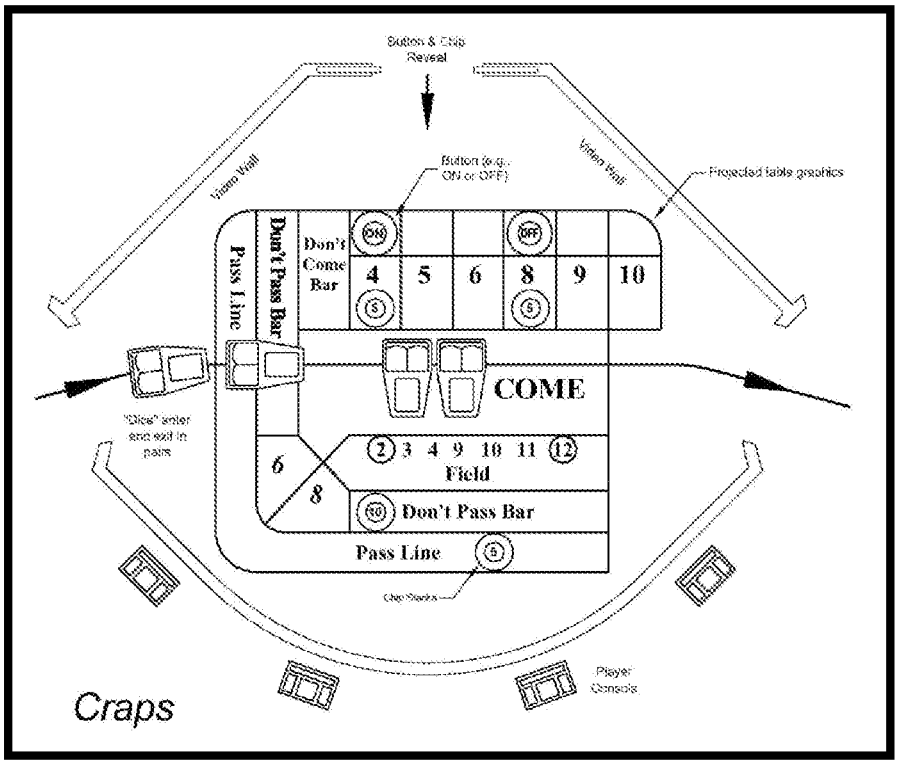
FIG. 15: An embodiment of the present invention related to games involving cards or dice, showing a facility game area arranged for the game of craps.

For the purposes of understanding how a game is conducted, the Facility example will be elaborated upon with a series of ride-game scenes in view. FIG. 13 shows how a game scene may engage a number of individual vehicles for a game of poker. Players (on the second floor) play as usual, while the Game and Ride Control Systems "deal" the vehicles into view, causing their on-board video Displays to show particular card faces, and otherwise manages their positions. The theatrical nature of the play can be amplified by a video wall backdrop, automated (unmanned) vehicles representing stacks of chips, projections on the floor, musical, verbal and other audio effects, and so on, Continuing the game playing example, FIG. 14 shows a similar game scene applied to a game of blackjack, which is managed similarly to poker, and with the vehicles again representing cards. FIG. 15 though applies to a game of craps, where the video screens of the vehicles display dice: revolving while the vehicle is in motion (representing a die-rolling activity), and coming to rest when the vehicle does (with the final die face "up" and exposed). In all these cases, players (on the second floor in this example) are playing the game as usual. The difference here is that the playing pieces are very large, and that there are people riding on or in them.

What is claimed is:

1. A passenger-conveying game-ride system comprised of:

a. At least one playing console having electronic means of transmitting user input to an electronic game control subsystem;

b. An electronic game control subsystem that:

i. Receives input from the one or more playing consoles, ii. Runs software related to a game, and iii. Sends display instructions to a passenger-conveying ride subsystem, iv. Said display being of electronic, kinematic, or both forms of indication;

c. A passenger-conveying ride subsystem that:

i. Receives said display instructions from the game control subsystem, ii. Physically conveys at least one passenger upon or within a vehicle, said vehicle capable of motion in at least one degree of freedom, iii. Displays certain conditions or information in accordance with the said instructions from the electronic game control subsystem;

d. Wherein the passenger-conveying ride subsystem utilizes one or more vehicles selected from a set comprised of:

i. A discrete vehicle having a single area to convey one or more seated or standing passengers;

ii. A composite vehicle having a plurality of areas to convey two or more groups of seated or standing passengers, Wherein, a. The individual vehicle seating area is further equipped with observational, electronic, or both means of identifying at least one passenger;

b. The game control subsystem having means of associating the score or result of a game played on-board the vehicle with said vehicle or its at least one passenger;

c. The game control subsystem having observational, electronic, or both means of conveying said association of score or result and vehicle or its passenger to other systems or observers outside the game-ride system.

2. The passenger-conveying game-ride system of claim 1 where:

a. The one or more vehicle passenger conveying areas are equipped with one or more on-board devices selected from the set comprised of:

i. A seat;

ii. A standing area;

iii. A restraint;

iv. A device permitting interaction between the passenger and the Game Control System, selected from a set comprised of:

1. A switch,
2. A potentiometer,
3. A joystick,
4. A touch-screen video display,
5. An electronic pointing device,
6. A microphone, or
7. A wireless communication device.

3. The passenger-conveying game-ride system of claim 1 adapted for gambling, where the one or more playing consoles are equipped with means of communicating betting and means of payment with the game control subsystem.

4. The passenger-conveying game-ride system of claim 1 where the playing console is remote, communicating by means of the Internet.

5. The passenger-conveying game-ride system of claim 1 where each vehicle is equipped with at least one means of indicating identity or status of the game element it represents, such indication means being selected from a set comprised of:

Each vehicle is equipped with at least one means of indicating identity or status of the game element it represents, such indication means being selected from a set comprised of:

a. A video screen configured for electronic representation, b. A mechanism configured for kinematic representation, c. A lighting subsystem configured for a luminous representation, d. An audio subsystem configured for audible representation, or e. A combination.

6. The passenger-conveying game-ride system of claim 1 where additional non-passenger-bearing game elements utilizing mobile platforms are also controlled by the electronic game control subsystem, said playing elements having display means selected from a set comprised of:

a. A stationary display of variously-illuminated regular shapes, b. A mobile display of variously-illuminated regular shapes, c. A stationary display of variously-elevated stacks of regular shapes, d. A mobile display of variously-elevated stacks of regular shapes, e. A stationary display of variously-illuminated and -elevated stacks of regular shapes, or f. A mobile display of variously-illuminated and -elevated stacks of regular shapes.

7. The passenger-conveying game-ride system of claim 6 where the non-passenger-bearing playing elements are dice, represented by a means selected from a set comprised of:

a. A stationary display of a mechanical die rotating on at least one axis, or b. A mobile display of a mechanical die rotating on at least one axis.

8. The passenger-conveying game-ride system of claim 1 where the vehicle has a single passenger-carrying area.

9. The passenger-conveying game-ride system of claim 8 where a plurality of said vehicles are commanded by the electronic game control subsystem to congregate in a grid-like or other pattern, displaying a larger and composite group of characters or symbols.

10. The passenger-conveying game-ride system of claim 8 where the ride path of the vehicle involves a series of episodic events, each episodic event type being selected from a set comprised of:

a. A game scene involving the said vehicle as a game playing component, b. A story-telling scene involving entertainment or education of vehicle passengers, c. A game-playing scene involving participation by vehicle passengers, or d. A public display scene involving exposure of the said vehicle and its passengers to view by a large group of people.

11. The passenger-conveying game-ride system of claim 1 where:

a. The ride subsystem is configured for one or more composite passenger-carrying mechanical vehicles;

b. Each said vehicle having a plurality of passenger-carrying seating or standing compartments;

c. The one or more said vehicles representing the broader game itself; and d. The plurality of said seating compartments being associated with means of displaying a plurality of symbols or characters of the game being represented.

12. The passenger-conveying game-ride system of claim 11 where:

a. The game represented is that of a slot machine;

b. The vehicle is a Ferris-wheel form of ride;

c. A plurality of vehicles are used;

d. Passenger seating compartments are individually associated with the display means; and e. The display means are selected from the set comprised of:

i. Wheel rotation, ii. Static display of a figure, iii. Changeable video display of a figure, iv. Sequencing of changeable video displays of figures around the wheels, or v. A combination.

13. The passenger-conveying game-ride system of claim 11 where:

a. The game represented is that of a roulette wheel;

b. The vehicle is selected from a set comprised of:

i. A ring of passenger-carrying seating or standing compartments rotating about the axis of a simulated roulette wheel, or ii. A chain of passenger-carrying seating or standing compartments rolling along a track around a simulated roulette wheel;

c. A roulette ball is represented by a means selected from a set comprised of:
i. A static display,
ii. Mechanical extension/retraction of a ball-like physical element,
iii. Pneumatic inflation/deflation of a ball-like physical element, or
iv. Electronic presentation of ball-like visual image.

14. The passenger-conveying game-ride system of claim 1 where the electronic game control subsystem and electronic ride control subsystem are substantially incorporated into a single subsystem.

15. The passenger-conveying game-ride system of claim 14 where:
a. Each vehicle represents an individual device of transport, such as an animal, plane, boat, spaceship, or other means;
b. Each vehicle platform is stationarily affixed to a position on the floor, yet imparts motion to the vehicle in one or more degrees of freedom selected from the set comprised of:
i. Pitch,
ii. Roll,
iii. Yaw,
iv. Heave,
v. Surge, or
vi. Sway;
c. Said motion being controlled by the electronic ride control system, at least partially in response to the input from the playing station.

16. An electronic control system for a passenger-conveying game and ride system comprised of:
a. A digital electronic game control subsystem having means of:
i. Reception of input from one or more player stations,
ii. Processing of game parameters and outcomes, and
iii. Issuance of electronic display commands;
b. One or more player consoles having means of issuing inputs to said game control subsystem;
c. A controlled passenger-conveying ride, having one or more passenger positions, said passenger-conveying ride having:
iv. Means of displaying via electronic indication, kinematic indication, or both;
v. Means of reception of electronic commands from said game control subsystem;
vi. Means of operating said display means in accordance with electronic commands; and
wherein the electronic control system for a passenger-conveying ride, further involving:
a. The digital game control subsystem having:
i. Means of random number generation, and
ii. Means of reception and processing of betting parameters from the playing consoles;
b. The one or more playing consoles having means of financial and wagering communication with the digital game control subsystem.

17. The electronic control system for a passenger-conveying ride of claim 16, where at least one player station is remotely located and in communication by means of the Internet.

* * * * *